US005520228A

United States Patent [19]

Fink, Jr. et al.

[11] Patent Number: 5,520,228

[45] Date of Patent: May 28, 1996

[54] FUEL EXTRACTION COUPLING FOR NOZZLE

[75] Inventors: Arthur C. Fink, Jr., Franklin County; Thomas O. Mitchell, St. Louis County, both of Mo.

[73] Assignee: Husky Corporation, Pacific, Mo.

[21] Appl. No.: 283,820

[22] Filed: Aug. 1, 1994

[51] Int. Cl.[6] ..... B67D 5/00

[52] U.S. Cl. ..... 141/59; 141/392; 141/44; 138/109; 138/113; 138/114; 285/133.1; 285/138

[58] Field of Search ..... 141/44–46, 59, 141/206, 392; 138/113, 114, 109, 115; 285/133.1, 138

[56] References Cited

U.S. PATENT DOCUMENTS

| | | | |
|---|---|---|---|
| 4,016,910 | 4/1977 | Dumpis et al. | 141/226 |
| 4,031,930 | 6/1977 | Sutcliffe et al. | 141/207 |
| 4,199,021 | 4/1980 | Thoma | 165/1 |
| 4,223,706 | 9/1980 | McGahey | 141/59 |
| 4,232,715 | 11/1980 | Pyle | 141/1 |
| 4,351,375 | 9/1982 | Polson | 141/98 |
| 4,429,725 | 2/1984 | Walker et al. | 141/59 |
| 4,687,033 | 8/1987 | Furrow et al. | 141/59 |
| 4,754,782 | 7/1988 | Grantham | 138/113 X |
| 5,005,613 | 4/1991 | Stanley | 141/45 |
| 5,035,271 | 7/1991 | Carmack et al. | 141/206 |
| 5,042,537 | 8/1991 | Grantham | 141/59 |
| 5,127,451 | 7/1992 | Fink, Jr. et al. | 141/206 |
| 5,197,523 | 3/1993 | Fink, Jr. et al. | 141/206 |
| 5,285,744 | 2/1994 | Grantham et al. | 141/59 |
| 5,351,727 | 10/1994 | Sanders et al. | 141/59 |

*Primary Examiner*—J. Casimer Jacyna
*Attorney, Agent, or Firm*—Paul M. Denk

[57] ABSTRACT

A fluid extraction hose strider connector coupling assembly for use in a fuel nozzle associated with a coaxial vapor recovery hose. The coaxial hose is operatively connected to the spider connector assembly. The spider connector assembly contains a spider connector and an hose connector mounted in the handle of the fuel nozzle. The spider connector has a fluid flow path formed therethrough terminating in a nipple. A first small bore tubing extends from the nipple into the vapor recovery hose to a point where condensed vapors undesirably pool. The spider connector is rotatably connected to the hose connector while maintaining a fluid pathway between the spider connector and hose connector. The hose connector has a fluid pathway formed therethrough terminating in a nipple. A second small bore tubing extends from the nipple to a venturi in the nozzle. Positive pressure created by the venturi draws fluid from the vapor recovery hose through the first small bore tubing, through the spider, through the hose connector and second small bore tubing and to the fuel being dispensed out of the nozzle spout.

4 Claims, 3 Drawing Sheets

FUEL EXTRACTION COUPLING FOR NOZZLE

BACKGROUND OF THE INVENTION

This invention relates to fuel dispensing nozzles of the type used to dispense gasoline for automobiles and the like, and more particularly, to an improvement to such nozzle assembly through which fuel which condenses in a vapor return hose of the nozzle assembly can be readily extracted and returned to the main fuel flow to allow clear vapor return to help reduce atmospheric pollution.

As is well known, gasoline dispensing nozzles of the type found in most service stations employ a spout which is inserted into the filler pipe of an automobile fuel tank. The size of the spout, and in particular, its diameter, is smaller than the diameter of the filler pipe. As a result, when the gas cap is removed from the filler pipe and the spout end of the nozzle is inserted there is typically substantial clearance between the side of the spout and the filler pipe. As a consequence, fuel vapors are allowed to escape from the tank into the atmosphere. Because of environment concerns, it is now a requirement in many locations that fuel dispensing nozzles be equipped so that this does not occur.

One way used to meet environmental requirements is to provide a nozzle with a flexible bellows assembly which fits over the spout. The bellows is circular in cross section with the diameter corresponding to the outer diameter of the filler pipe. When the nozzle is inserted into the pipe, the end of the bellows fits snuggly against the opening of the pipe so that the gasoline vapors escape into the bellows and are directed into a vapor recovery passage in the nozzle and eventually into the system for recovery. For example, see U.S. Pat. Nos. 4,031,930 and 4,016,910 which are assigned to the Husky Corporation, the same assignee as the present application. This is the balanced pressure type of vapor recovery.

Vapor recovery nozzles are provided in two types. One is vacuum assist, using a vacuum attraction created within the nozzle by means of a pump located back in the dispenser. This partial vacuum has a tendency to attract vapors back into the nozzle, through its hose, and back into the dispenser for collection.

A second system utilizes what is generally identified as the balanced pressure system, whereby the gasoline is pumped into the automobile fuel tank and the displaced air is forced back towards the nozzle, which forces the gasoline vapors to be captured through a bellows type boot for return back into the fuel line and, eventually, pushed back into the underground storage tank.

Examples of patents that disclose these types of systems, as previously reviewed, include the Walker U.S. Pat. No. 4,429,725, which shows the vacuum assist vapor recovery system; the Polson U.S. Pat. No. 4,351,375, which utilizes the direct force of the flow of dispensed fuel to regulate the opening or closing of a vapor recovery passageway, rather than the peripheral pressure generated by the fuel to obtain such; U.S. Pat. No. 4,232,715 which discloses the use of concentrically formed nozzle spout, including a vapor passageway, and which opens the vapor recovery valve through the actuation of a plunger when the fill pipe of the vehicle has the nozzle pressed against it when the nozzle is inserted for filling of the fuel tank. Other patents related to vacuum assists for removing vapors include the McGahey U.S. Pat. No. 4,223,706, and Lasiter U.S. Pat. No. 4,199,021.

U.S. Pat. No. 5,127,451 to Fink, Jr. et al. discloses a fuel dispensing nozzle improvement used with a vapor recovery hose attached between the nozzle and the fuel dispenser constructed as coaxial hoses, having an inner hose for the flow of fuel, and an outer hose, surrounding the inner hose, for the flow of vapors. The inner fuel flow hose cooperates with the outflow spout of the nozzle and the outer vapor recovery hose cooperates with a vapor flow pathway formed in the nozzle.

Fuel vapors occasionally condense in the vapor flow pathway in coaxial hoses and the condensed fuel needs to be drawn off or else the vapor return passage will be blocked, built up excessive pressure, and not work as intended. Furthermore, where a positive pressure is applied to the vapor flow pathway to draw vapors into the system, there is the problem with fuel being drawn into the vapor flow passage. The fuel will pool in the vapor flow pathway of the hose, especially if the hose has a depending loop when hanging on the pump.

Various attempts have been made to correct this problem, but there is still a need for an improved, simple, reliable and cost-effective solution. U.S. Pat. No. 4,687,033 to Furrow et al., discloses a evacuator system employing a venturi pump located in the hose to suck fuel back into the fuel flow line from the vapor flow path of the hose. In the Furrow invention, the venturi aspirator for removing accumulated fuel from the vapor path of the vapor recovery hose is included in the system between the nozzle and the meter housing. The venturi pump is located within the fuel flow path of the product hose for pumping out or aspirating liquid fuel that may accumulate in the vapor path of the vapor recovery hose.

U.S. Pat. No. 5,197,523, assigned to Husky Corporation, assignee of the present invention, employs a small bore extraction hose having one end which extends into the vapor recovery hose to a point where the condensed vapors will pool. The opposite end of the extraction hose is operatively associated with a venturi port located in the nozzle venturi which creates a positive pressure to draw the pooled fuel out of the vapor recovery hose, and direct it into the mainstream of fuel flow being dispensed. The disclosure of U.S. Pat. No. 5,197,523 is hereby incorporated by reference.

There are several problems associated with prior art vapor extraction devices. First, the vapor extraction devices are difficult or expensive to retrofit on existing fuel dispensing assemblies. If the extraction device is the type that is incorporated in the nozzle, it generally must be incorporated in the nozzle by the manufacture before fuel distribution. Furthermore, the small bore extraction tube extending from a venturi in the nozzle to the pooled fuel in the outer vapor flow coaxial hose has a tendency to get wrapped around the inner fuel flow hose, decreasing the efficiency of the system.

SUMMARY OF THE INVENTION

It is therefore, a principal object of the present invention to provide a vapor recovery fuel nozzle which incorporates a spider connector assembly having a spider connector and a hose connector to connect a small bore fuel extraction hose inserted into the vapor recovery hose of a coaxial fuel delivery hose to a venturi located in the nozzle to provide positive suction through venturi attraction for the extraction of pooled fuel from the vapor recovery hose.

It is another object of the present invention to provide a spider connector and associated hose connector that can be retrofitted to a vapor recovery nozzle and associated vapor recovery hose to connect a small bore extraction tube between the vapor recovery hose and the venturi located in the nozzle.

Yet another object of the present invention is to provide a spider connector and associated hose connector to connect a small bore extraction hose between a venturi located in a nozzle and the vapor recovery hose wherein the spider connector can rotate within the hose connector to prevent the small bore flexible extraction tube connected to the spider from becoming wrapped and bound around the fuel flow hose.

A still further object of the present invention is to provide a spider connector and an associated hose connector that is economical to manufacture, easy to install and well suited for its intended purposes.

In accordance with the invention, generally stated, a fuel dispensing nozzle has a body, including a fuel passage for the fuel to flow from a source thereof through the body. A spout is attached to the body with fluid connection therewith for fuel to flow into the spout from the passage. The distal end of the spout forms a mouth insertable into a fuel tank. A vapor flow passage in the body of the nozzle connects with a vapor flow orifice in the spout through which vapors are drawn from the tank into the passageway. Both the fuel flow passage and the vapor flow passage in the nozzle terminate in a coaxial hose inlet orifice formed in the handle of the body. A coaxial vapor recovery hose is inserted in the orifice. The outer vapor recovery hose of the coaxial hose is operatively connected to the vapor flow passageway and the inner fuel flow hose of the coaxial is in fluid connection with the fluid flow passage. An hose connector within the handle orifice is disposed to accept the inner fuel flow hose. The hose connector has a peripheral nipple connected to as small bore extraction tube which communicates with the nipple to a venturi located in the nozzle. A fluid passageway is formed from the nipple, through the inner hose connector. A spider connector is in the sealed relationship with the hose connector. The spider connector has a passageway formed therethrough in fluid communication with the passageway within the hose connector. The spider has a nipple formed on the periphery thereof in fluid connection with the passageway. The nipple accommodates a small bore extraction tube which extends from the spider through the outer coaxial hose vapor recovery pathway to a position in the vapor recovery hose in which condensed vapors pool. A continuous passageway is thus formed from the venturi located in the nozzle, through the first small bore extraction tubing, through the nipple formed on the hose connector, through the respective passageways, through the nipple formed on the spider and through the small bore extraction tubing extending down into the approximate low point of vapor recovery hose. The spider and the associated small bore extraction tube can rotate within the hose connector while maintaining a seal thereby preventing the small bore extraction tube, associated with the spider, from becoming wrapped around the inner fuel flow hose of the coaxial hose. The inner hose connector and the spider coupling can be retrofitted on nozzles in the field.

BRIEF DESCRIPTION OF PREFERRED EMBODIMENTS

Figure 1:
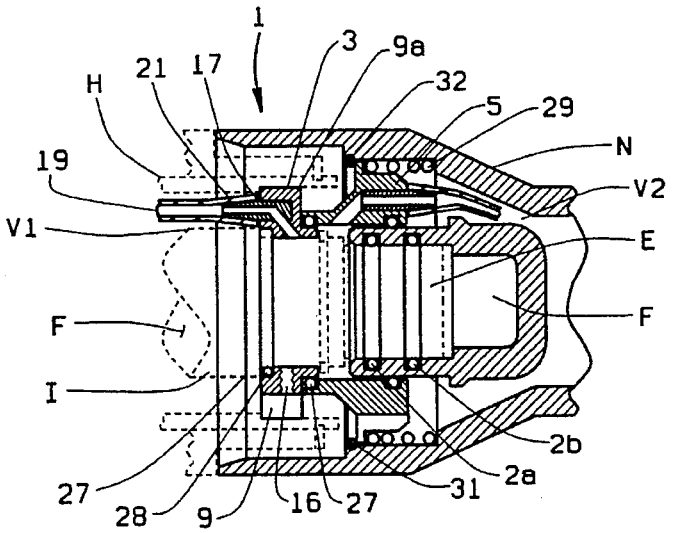
FIG. 1 is a partial cross-sectional view of the spider connector and inner hose connector of the present invention mounted in the hose mounting orifice in the handle of a fuel dispenser nozzle.
Figure 2:
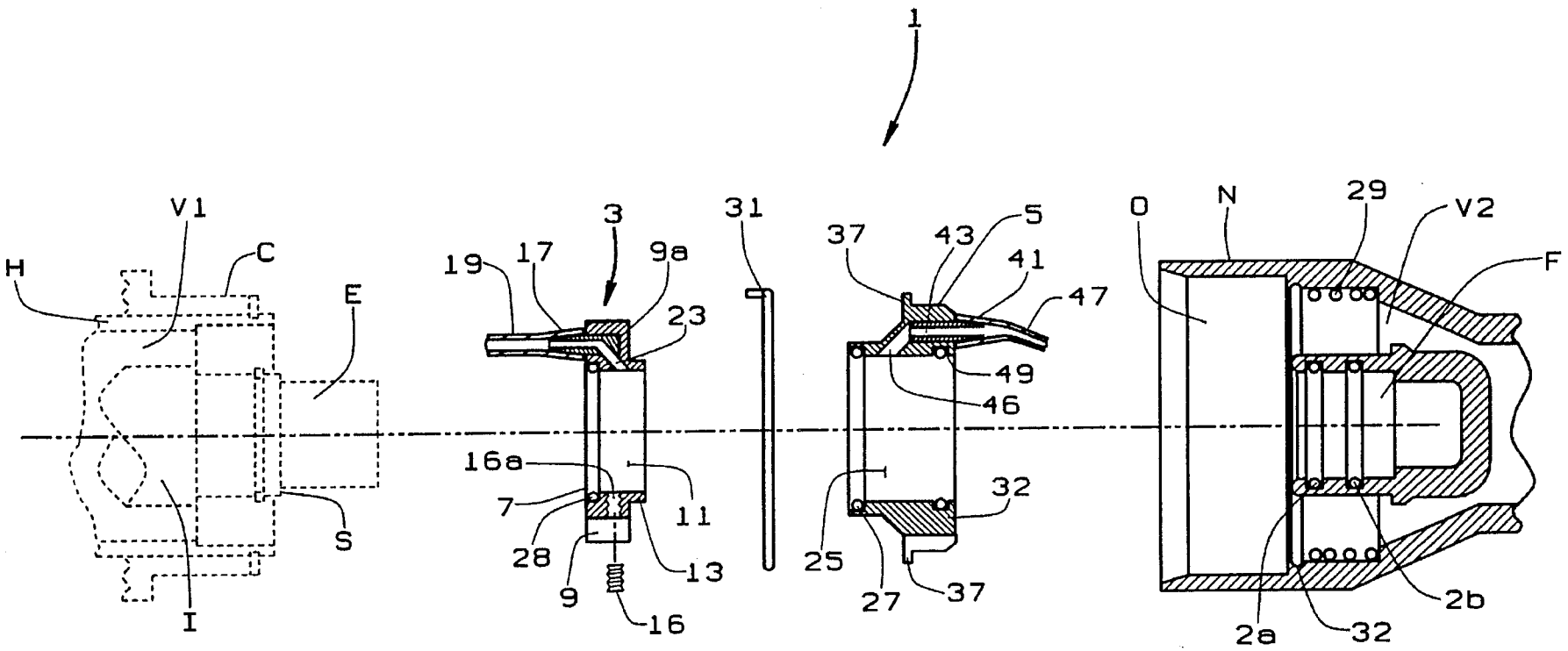
FIG. 2 is an exploded, side elevational cross section of the spider connector and inner hose connector as shown in FIG. 1.

The spider connector assembly for extracting condensed and back splashed pooled fuel from a vapor flow path of a concentric vapor recovery hose is indicated generally by reference numeral 1 in FIGS. 1 and 2. Assembly 1 has two major elements, a novel spider connector 3 and hose connector 5, as will be described in detail hereinafter.

As shown in FIGS. 1 and 2, assembly 1 is mounted in a butt or handle end of a conventional fuel system nozzle N. A concentric vapor recover hose H is connected to nozzle N. Hose H has a threaded outer coupling end C which threadedly engages inside orifice O. Hose H has a external hose, shown as H, defining a vapor flow path V1 and a concentric inner fuel flow hose I. Hose I has a coupling E which extends through assembly 1 into fluid flow path F formed in nozzle N. Flow path F has a pair of internal "O" rings **2*a* and 2*b* to form a fluid-tight seal around coupling E when coupling E is in inserted into flow path F. Nozzle N has a vapor flow path V2** formed therein.

Figure 3:
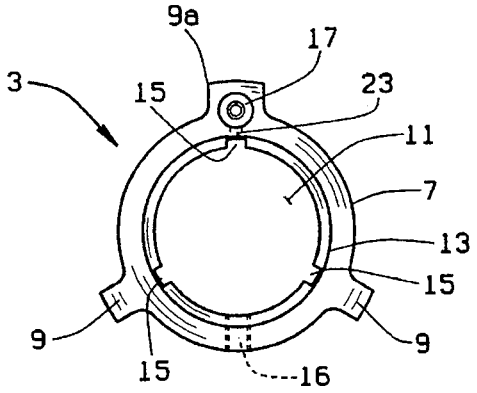
FIG. 3 is a front elevational view of the spider connector of the present invention.
Figure 4:
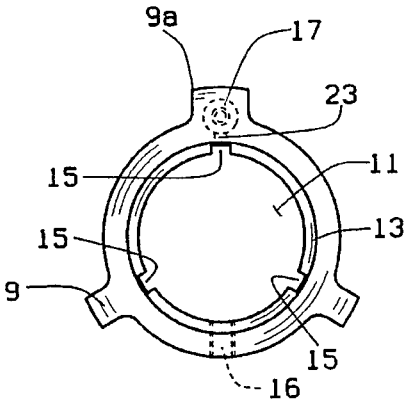
FIG. 4 is a rear elevational view of the spider connector of the present invention.

Spider 3 is shown in greater detail in FIGS. 2–4. Spider 3 has a generally annular body 7 with a least two regular lobes 9 and a third, larger lobe **9*a*, spaced equidistant about body 7. An annular bore 11 is formed centrally through spider 3. A concentric collar 13 extends from around bore 11. Collar 13 has a plurality of cutouts 15 to form condensed vapor flow passages around coupling E when coupling E is inserted through annular bore 11**.

As can be seen in FIGS. 1 and 2, coupling E of inner hose I extends into annular bore 11 and can be secured by a set screw 16 tightened into threaded hole **16*a*. Lobe 9*a* has a hollow nipple 17 formed thereon. Flexible small bore tubing 19 is secured on nipple 17 by a tight friction. A tightly wound spring or other fastening device (not shown) can be placed around tubing 19 and nipple 17 to help secure tubing 19 in place. Tubing 19 extends into vapor recovery pathway V1 between outer hose H and inner hose I any desired distance so as to terminate in path V1 where condensed vapors pool as fluid. A fluid flow path 23 is formed internally through nipple 17 and lobe 9*a* opening into cutout 15 of annular bore 11**.

Collar 13 seats in one end of annular bore 25 of hose connector 5. "O" rings seal 27 forms a fluid tight seal. Collar 13 can rotate within bore 25 while retaining the fluid tight seal. Spider 3 can be rotated so that tubing 19 can be appropriately positioned within vapor flow path V1 without wrapping around inner hose I. "O" ring seal 28 abuts a shoulder S formed on inner hose I between hose I and coupling E to form a fluid tight seal between hose I and spider 3 when assembled. Connector 5 is mounted within nozzle N and biased toward hose H by coil spring 29. Connector 5 is secured within nozzle N by a spring clip 31 which seats in annular groove 32 formed in the interior wall of nozzle N.

Figure 5:
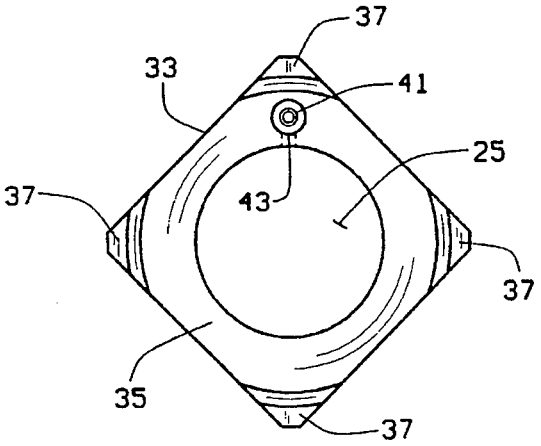
FIG. 5 is a front elevational view of the inner hose connector of the present invention.
Figure 6:
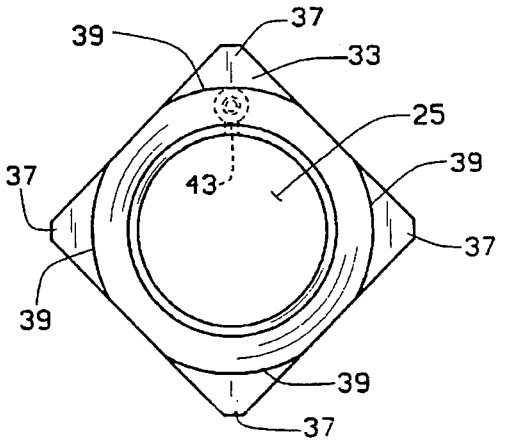
FIG. 6 is a rear elevational view of the inner hose connector of the present invention.

Connector 5 is shown in greater detail in FIGS. 5 and 6. Connector 5 has a generally square base section 33. An annular collar 35 extends outward from a side of base section 33. Annular bore 25, as stated above, is formed through connector 5. It should be noted that annular bore 25 is of great diameter thus coupling E on hose I thereby creating a flowpath around coupling E within bore 25 when coupling E is inserted through bore 25. Generally flat corners 37 are formed on base 33. Spring 29 engages the back side of flat corners 37 and spring clip 31 engages the front side of flat corners 37 to secure the connector in position. Rounded corners 39 formed on the back side of base 33 seat snugly within bias spring 29.

Figure 7:
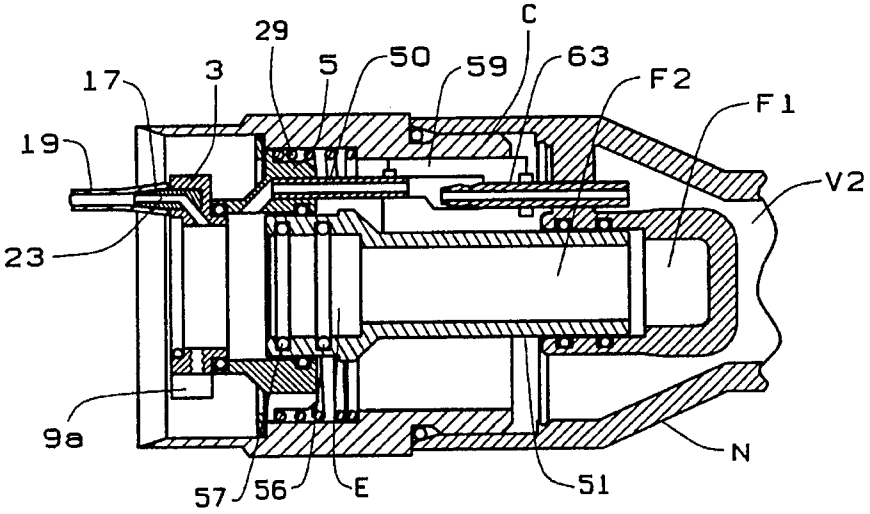
FIG. 7 is a partial, cross sectional view of an alternative embodiment of the spider connector and inner hose connector employed in a standard nozzle.
Figure 8:
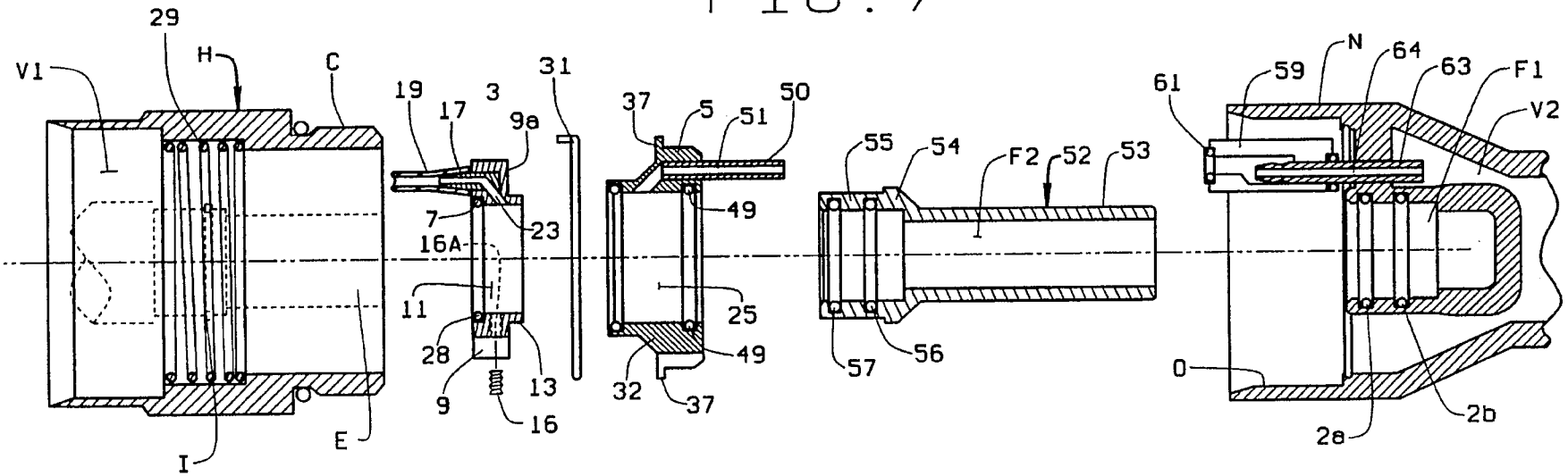
FIG. 8 is an exploded view of the elements of FIG. 7.

A hollow nipple 41 extends from one corner of base 33. A fluid flow path 43 is formed through nipple 41 and base section 33 terminating in orifice 46 which open into annular bore 25. Small bore plastic tubing 47 is attached to nipple 41 and extends through flow channel V2 terminating at a venturi (not shown) in the spout section (not shown) of nozzle N. "O" ring seal 49 forms a fluid-tight seal between bore 25 and flowpath F. FIGS. 7 and 8 illustrate an alternative embodiment of the vapor extraction spider connector assembly of the present invention. The alternate embodiment is designed to install in an existing or "old" nozzle assembly. As is apparent from the drawings, spider 3 is constructed in accordance with the previous description and specification. Connector 5 is, in general, constructed in accordance with the previous description. However, instead of a nipple, connector 5 has a hollow extension tube 50 formed integrally thereon and defining flowpath 51. Furthermore, this embodiment employs an inner hose coupling 52. Inner hose coupling 52 functions as an extension for coupling E on the end of inner hose I to form a flow path $F_2$ between the inner hose I and flow path F, located within the nozzle. Hose coupling 52 has an elongated, tubular section 53 defining a flow channel $F_2$. Tubular section 53 terminates in an angularly slope shoulder 54. An annular adapter portion 55 extends from shoulder 54 and is seated in orifice 25 of connection 5. Coupling E seats in annular position 55. "O" rings seals 56, 57 and 49 form a fluid tight seal. Nozzle N has an extension adapter 59 to accept tubular extension 50 formed on connector 5. "O" rings seal 61 forms a tight seal when assembled. Small bore tube 63 extends from adapter 59 and defines a flow path 64 which is in fluid connection with flow path 51 as well as flowpath $V_2$.

In use, the first preferred embodiment provides a continuous flow path from fuel back splashed and pooled within the hose H through flow path V1, through small bore tubing 19, path 23, cutouts 15, around coupling E, through path 41, small bore tubing 47 to a venturi (not shown) located in the spout (not shown) in nozzle N. In the second preferred embodiment, there is a flow path created from V1, through tubing 19, path 23, cutouts 15, around coupling E, through path 51 and path 64 to flow path V2 where the venturi (not shown) exerts enough pressure to pull fluid through the previously described and pathways of a spout (not shown).

It will be apparent to those skilled in the art that various modifications and changes can be made in the various elements of the novel spider connector assembly without departing from the scope of the appended claims. Therefore the foregoing description and drawings should be viewed as illustrative and should not be construed in a limiting sense.

We claim:

1. In a nozzle assembly for dispensing fuel from a source into a container, such as a fuel tank for a vehicle, the nozzle assembly attached to a nozzle body in which is defined a fuel flow passage, a spout attached to the body and in fluid communication therewith for directing fuel to the fuel tank, and a concentric coaxial fuel dispensing and vapor recovery hose securing to the nozzle body to conduct fuel to the nozzle body during dispensing and to return captured vapors from the fuel tank back to a fuel source, said nozzle also incorporating a venturi, the improvement comprising:

means for connecting the coaxial hose to the nozzle body and for extracting fuel from the vapor return path of the concentric vapor recovery hose, said nozzle body having a back end forming a cavity in which the means for connecting the coaxial hose locates, said means for connecting including a connector fitting within the nozzle cavity, said connector being exteriorly shaped to allow the passage of returning vapors thereby and to position the connector within the nozzle cavity, the exterior shape of the connector being square, said connector having a central passage provided therethrough, a spider incorporating a series of radially extending lobes and also having a central bore therethrough, said spider having an integrally extending concentric collar formed around its bore and extending into the connector passage and forming a fluidic seal therewith, said spider lobes allowing the further passage of returning vapors therepast, said vapor recovery hose securing onto the periphery of said spider, and said fuel dispensing hose securing within the spider's central bore, and the fuel flow path of the nozzle body communicating within the connector central passage to conduct the flow of fuel during dispensing.

2. The invention of claim 1 wherein said collar of the spider can pivot within the connector passage.

3. The invention of claim 1 and including a fuel hose coupling connecting with the connector and communicating with its central passage, said coupling providing an extension for coupling of the fuel dispensing hose within the nozzle cavity to the fuel flow path provided through the nozzle.

4. In a nozzle assembly for dispensing fuel from a source into a container, such as a fuel tank for a vehicle, the nozzle assembly attached to a nozzle body in which is defined a fuel flow passage, a spout attached to the body and in fluid communication therewith for directing fuel to the fuel tank, and a concentric coaxial fuel dispensing and vapor recovery hose securing to the nozzle body to conduct fuel to the nozzle body during dispensing and to return captured vapors from the fuel tank back to a fuel source, said nozzle also incorporating a venturi, the improvement comprising:

means for connecting the coaxial hose to the nozzle body and for extracting fuel from the vapor return path of the concentric vapor recovery hose, said nozzle body having a back end forming a cavity in which the means for connecting the coaxial hose locates, said means for connecting including a connector fitting within the nozzle cavity, said connector being exteriorly shaped to allow the passage of returning vapors thereby and to position the connector within the nozzle cavity, said connector having a central passage provided therethrough, a spider incorporating a series of radially extending lobes and also having a central bore therethrough, said spider having an integrally extending concentric collar formed around its bore and extending into the connector passage and forming a fluidic seal therewith, said spider lobes allowing the further passage of returning vapors therepast, said vapor recovery hose securing onto the periphery of said spider, and said fuel dispensing hose securing within the spider's central bore, and the fuel flow path of the nozzle body communicating within the connector central passage to conduct the flow of fuel during dispensing; there also being a channel formed through the connector, and a channel formed through the spider, said channels provided for communicating the venturi effect created by the nozzle venturi to the vapor recovery hose for extracting any condensed fuel, and a clip cooperating within the nozzle cavity for retaining the connector therein, and a spring means biasing said connector against the said clip.

* * * * *